US005189940A

United States Patent [19]

Hosseini et al.

[11] Patent Number: 5,189,940

[45] Date of Patent: Mar. 2, 1993

[54] METHOD AND APPARATUS FOR CONTROLLING AN IMPLEMENT

[75] Inventors: Javad Hosseini; Eric A. Hutchison, both of Peoria; Randall M. Mitchell, Washington; Weldon L. Phelps, Dunlap; James E. Schimpf, Plainfield, all of Ill.

[73] Assignee: Caterpillar Inc., Peoria, Ill.

[21] Appl. No.: 759,390

[22] Filed: Sep. 13, 1991

[51] Int. Cl.[5] ..... F15B 13/16

[52] U.S. Cl. ..... 91/361; 91/367; 91/403; 91/435; 91/461

[58] Field of Search ..... 91/361, 367, 403, 435, 91/453, 461; 60/469

[56] References Cited

U.S. PATENT DOCUMENTS

| | | | |
|---|---|---|---|
| 3,789,739 | 2/1974 | Krehbiel et al. | 91/461 |
| 3,892,079 | 7/1975 | Hirano et al. | 91/527 |
| 4,015,729 | 4/1977 | Parquet et al. | 214/138 R |
| 4,109,812 | 8/1978 | Adams et al. | 214/762 |
| 4,166,506 | 9/1979 | Tezuka et al. | 91/453 |
| 4,358,989 | 11/1982 | Tordenmalm | 91/361 |
| 4,552,503 | 11/1985 | Mouri et al. | 414/687 |
| 4,844,685 | 7/1989 | Sagaser | 414/700 |

*Primary Examiner*—Edward K. Look
*Assistant Examiner*—F. Daniel Lopez
*Attorney, Agent, or Firm*—Steven R. Janda

[57] ABSTRACT

Vehicles having implements are typically used to perform repetitive functions in work cycles. An implement control system raises and lowers an implement relative to the vehicle and reduces the stresses applied to the vehicle from abruptly stopping the motion of the implement. A lever pilot signal is produced in response to the pivotal position of a control lever. An electrohydraulic pilot signal is also produced. The pilot signal having the greater pressure is directed to a main valve for controlling the position of the implement. The method and apparatus of the instant invention are applicable to a number of vehicles having a hydraulically operated implement.

25 Claims, 4 Drawing Sheets

METHOD AND APPARATUS FOR CONTROLLING AN IMPLEMENT

DESCRIPTION

1. Technical Field

This invention relates generally to an apparatus for controlling the extension and retraction of a hydraulic cylinder, and more particularly to an apparatus for reducing the speed at which a hydraulic cylinder is extending or retracting.

2. Background Art

Vehicles such as wheel type loaders include work implements capable of being moved through a number of positions during a work cycle. Such implements typically include buckets, forks, and other material handling apparatus. The typical work cycle associated with a bucket includes positioning the bucket and associated lift arm in a digging position for filling the bucket with material, a carrying position, a raised position, and a dumping position for removing material from the bucket.

Control levers are mounted at the operator's station and are connected to a hydraulic circuit for moving the bucket and/or lift arms. The operator must manually move the control levers to open and close hydraulic valves that direct pressurized fluid to hydraulic cylinders which in turn cause the implement to move. For example, when the lift arms are to be raised, the operator moves the control lever associated with the lift arm hydraulic circuit to a position at which a hydraulic valve causes pressurized fluid to flow to the head end of a lift cylinder thus causing the lift arms to rise. When the control lever returns to a neutral position, the hydraulic valve closes and pressurized fluid no longer flows to the lift cylinder.

In normal operation, the implement is often brought to an abrupt stop after performing a given work cycle function This can occur, for example, when the implement is moved to the end of its range of motion. If the lift arms or hydraulic cylinders impact with a mechanical stop, significant forces are absorbed by the lift arm assembly and the hydraulic circuit. This results in increased maintenance and accelerated failure of associated parts.

A similar situation occurs when a control system holds the control lever in a detent position at which the associated hydraulic valve is held open until the lift arm assembly or implement reaches a predetermined position. The control system then releases the control lever which is spring biased toward the neutral position. The springs quickly move the control lever to the neutral position which in turn abruptly closes the associated hydraulic valve. Thus, the lift arm assembly and/or bucket is brought to an abrupt stop. Such abrupt stops result in stresses being exerted on the hydraulic cylinders and implement linkage from the inertia of the bucket, lift arm assembly, and load. The abrupt stops also reduce operator comfort and increase operator fatigue.

Stresses are also produced when the vehicle is lowering a load and the operator quickly closes the associated hydraulic valve. The inertia of the load and implement exerts forces on the lift arm assembly and hydraulic system when the associated hydraulic valve is quickly closed and the motion of the lift arms is abruptly stopped. Such stops cause increased wear on the vehicle and reduce operator comfort. In some situations, the rear of the tractor can even be raised off the ground.

To reduce these stresses, systems have been developed to more slowly and smoothly stop the motion of the implement in these situations. One solution to this problem is disclosed in U.S. Pat. No. 4,109,812, issued to Adams et al. on Aug. 29, 1978. A device is provided for halting the flow of hydraulic fluid to the cylinders just prior to the lift arms reaching the end of their range of motion and trapping fluid within the cylinder to act as a hydraulic cushion. While this approach is acceptable for slowing the implement before it reaches a mechanical stop, this device is not readily adapted to use with a control system that stops the implement at adjustable kickout positions. Such kickout positions are chosen in response to the parameters of the work cycle and are typically different from the maximum raise and lower positions. Furthermore, this system is unable to sense conditions in which the operator moves the control lever too quickly to allow the hydraulic system to operate smoothly. The effects of quick movement of the control lever are particularly pronounced when the vehicle is lowering a heavy load. Such a hydraulic cushion is also not readily controllable in response to changes in operating conditions.

An alternative system is disclosed in U.S. Pat. No. 4,358,989, issued to Tordenmalm on Nov. 16, 1982. This system utilizes an electrohydraulic valve to extend and retract a piston within a hydraulic cylinder. When the piston reaches a position that is a predetermined distance from the end of stroke, the control system progressively closes the electrohydraulic valve as the piston continues to move toward the end of stroke. While this system adequately reduces the velocity of the piston before it reaches a hard stop, it is not operable to perform other desirable implement functions, such as adjusting kickout positions, defining multiple raise kickout positions, and performing float operations in which fluid from the rod end of the hydraulic circuit is allowed to flow to the hydraulic tank. Also, if the electronic system fails, the operator is unable to operate the hydraulic cylinders.

The present invention is directed to overcoming one or more of the problems set forth above.

Disclosure of the Invention

The invention avoids the disadvantages of known implement controls and provides a system for controllably reducing the speed of a hydraulically operated work implement. The instant invention combines the advantages of hydraulic and electrohydraulic implement controls to provide a reliable and flexible implement control system.

In one aspect of the present invention, an apparatus for controllably raising and lowering an implement relative to a work vehicle is provided. The implement is pivotally connected to the work vehicle and is movable to and between maximum raised and lowered positions in response to the extension and retraction of a hydraulic cylinder. A lever operated hydraulic valve produces a lever pilot signal having a first pressure in response to the position of a control lever. An electrohydraulic valve produces an electrohydraulic pilot signal having a second pressure. One of the first and second pressures is selected and the hydraulic cylinder is controlled in response to the selected pressure.

In another aspect of the present invention, a method for controllably raising and lowering an implement relative to a work vehicle is provided. The implement is pivotally connected to the work vehicle and is movable to and between maximum raised and lowered positions in response to the extension and retraction of a hydraulic cylinder. A control lever is pivotally movable to and between a neutral position, a predetermined raise detent position, and a predetermined lower detent position. The method comprises the steps of producing a lever pilot signal in response to the pivotal location of the control lever, producing an electrohydraulic pilot signal, selecting the pilot signal having the greater pressure, and controlling the position of the implement in response to the selected pilot signal.

The invention also includes other features and advantages which will become apparent from a more detailed study of the drawings and specification.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
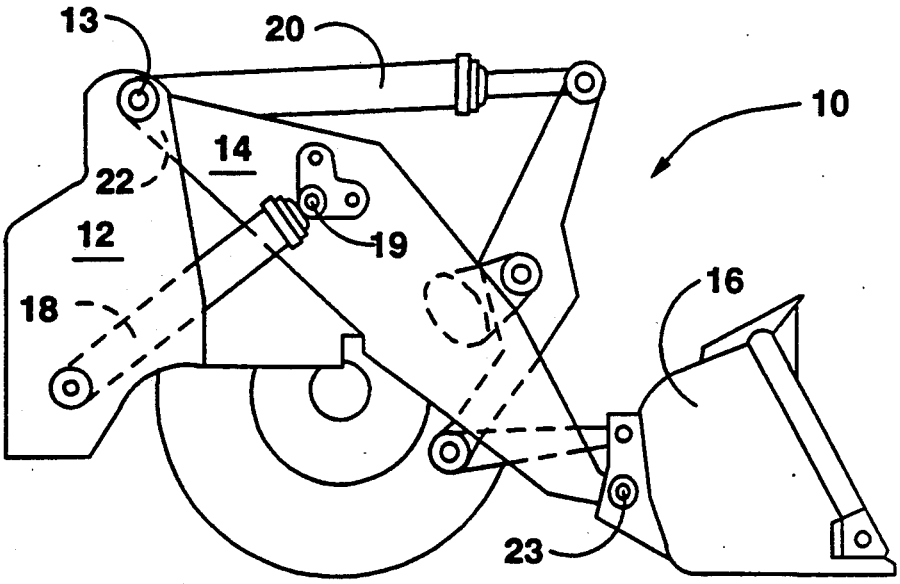
FIG. 1 is a side view of the forward portion of a loader vehicle.

In FIG. 1 an implement control system is generally represented by the element number 10. Although FIG. 1 shows a forward portion of a wheel type loader vehicle 12 having a payload carrier in the form of a bucket 16, the present invention is equally applicable to vehicles such as track type loaders, hydraulic excavators, and other vehicles having similar loading implements. The bucket 16 is connected to a lift arm assembly 14, which is pivotally actuated by two hydraulic lift cylinders 18 (only one of which is shown) about a pair of lift arm pivot pins 13 (only one shown) attached to the vehicle frame. A pair of lift arm load bearing pivot pins 19 (only one shown) are attached to the lift arm assembly 14 and the lift cylinders 18. The bucket 16 can also be tilted by a bucket tilt cylinder 20. A lift cylinder extension sensor 22 is included in connection with the lift cylinders 18 and a tilt cylinder extension sensor 23 is included in connection with the tilt cylinder 20.

In the preferred embodiment, the lift and tilt cylinder extension sensors 22,23 are rotary potentiometers connected to and between the lift arm pivot pins 13 and the lift arm assembly 14. The rotary potentiometers produce pulse width modulated signals in response to the angular position of the lift arms with respect to the vehicle and the bucket 16 with respect to the lift arm assembly 14. Since the angular position of the lift arms is a function of lift cylinder extension, the signal produced by the rotary potentiometer in the lift cylinder extension sensor is a function of lift cylinder extension. Similarly, since the angular position of the bucket 16 is a function of tilt cylinder extension, the signal produced the rotary potentiometer in the tilt cylinder extension sensor 23 is a function of tilt cylinder extension. Other embodiments may use a radio frequency (RF) sensor disposed within the hydraulic cylinders or any other device capable of measuring, either directly or indirectly, the relative extension of a hydraulic cylinder.

Figure 2:
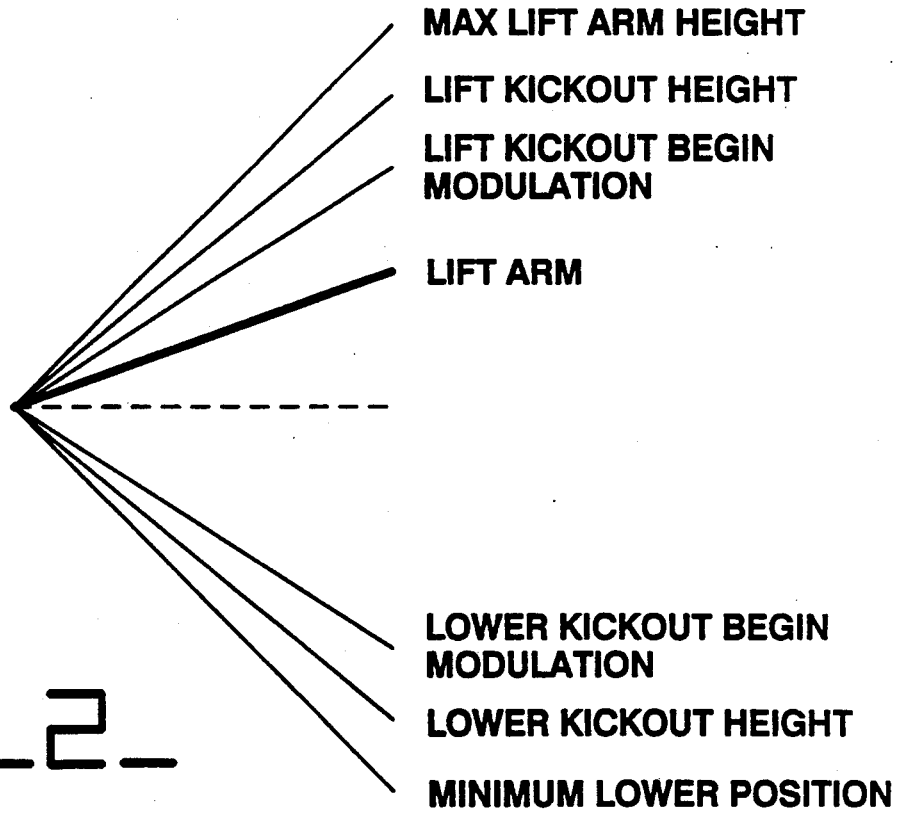
FIG. 2 illustrates a plurality of positions through which the lift arms of a work vehicle are moved.

FIG. 2 diagrammatically illustrates the range of motion of the lift arm assembly 14 and a plurality of intermediate positions through which the lift arm assembly 14 is moved during a work cycle. The maximum lift arm height is the position of the lift arm assembly 14 at which a mechanical stop prevents the lift cylinders 18 from further raising the bucket 16. Similarly, the minimum lower position is the position of the lift arm assembly 14 at which a mechanical stop prevents the lift cylinders 18 from further lowering the bucket 16. A midpoint is shown generally by the dashed line in FIG. 2 and substantially bisects the range of motion of the lift arm assembly 14 which is defined by the maximum lift arm height and the minimum lower position.

The lift and lower kickout heights illustrate positions to which the lift arm assembly 14 is to be moved while performing a work cycle. For example, the lift kickout height corresponds to the desired dump height for the bucket 16, and the lower kickout height corresponds to the return-to-dig position for the bucket 16. Advantageously, the lift and lower kickout heights are selected by the operator at the beginning of a work cycle and are changeable in response to the parameters of the particular work cycle being performed.

The lift and lower kickout begin-modulation-positions correspond to the positions of the lift arm assembly 14 at which the implement control system begins to reduce the speed at which the bucket is being moved toward the associated kickout position. The begin-modulation-positions are advantageously selected to allow the implement control system to completely stop the bucket at the appropriate kickout height without unduly stressing the lift arm assembly 14 or reducing operator comfort.

Figure 3:
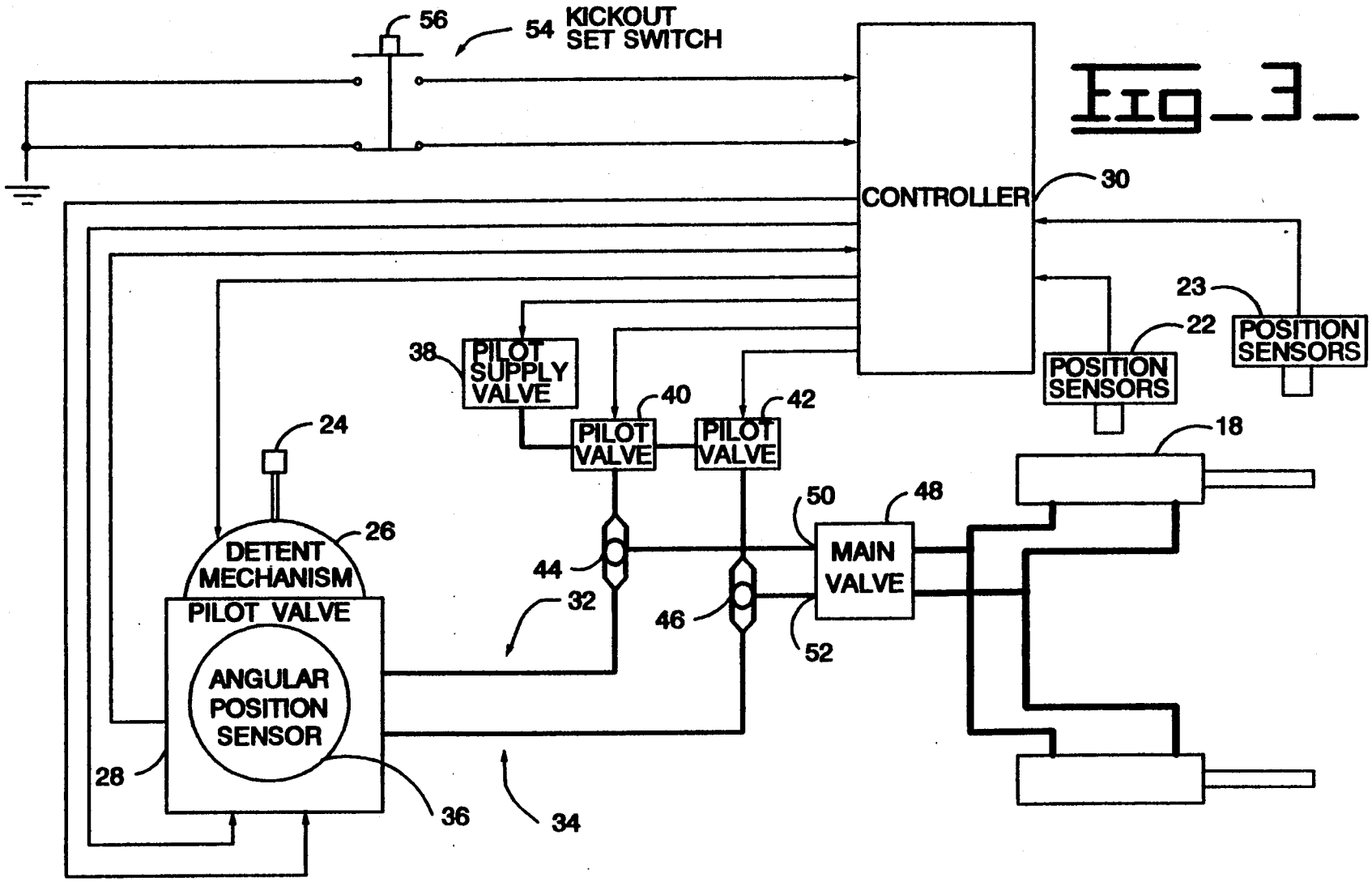
FIG. 3 is a diagrammatic illustration of an embodiment of the invention.

Referring now to FIG. 3, an embodiment of the implement control system is diagrammatically illustrated. A control lever 24 is spring biased toward a neutral position and is connected to a detent mechanism 26 which is actuatable to hold the control lever 24 in predetermined raise and lower detent positions in response to the control lever being moved beyond these detent positions. Since the velocity of the implement is a function of control lever position, the raise and lower detent positions are chosen in response to design preferences regarding the desired velocity of the implement while the work cycle is being performed. The detent mechanism 26 includes solenoids (not shown) for controllably releasing the control lever 24 from the raise and lower detent positions in response to receiving a kickout signal from a controller 30. Typically, the kickout signal is produced in response to the lift arm assembly being moved to the kickout begin-modulation-position.

The control lever 24 is connected to a lever operated pilot valve 28 which produces a lever pilot signal in response to the control lever 24 being in a position substantially different from the neutral position. Since the control lever 24 is generally movable in two directions, the lever operated pilot valve 28 directs the lever pilot signal to the raise pilot line 32 in response to the control lever 24 being moved in one of the directions, and directs the lever pilot signal to the lower pilot line 34 in response to the control lever being moved in the other direction.

A control lever position sensor 36 is connected to and between the control lever 24 and the controller 30. The control lever position sensor 36 preferably includes a rotary potentiometer which produces a pulse width modulated lever position signal in response to the pivotal position of the control lever 24; however, any sensor that is capable of producing an electrical signal in response to the pivotal position of the control lever would be operable with the instant invention.

An electrohydraulic pilot supply valve 38 is connected to and between the controller 30, a hydraulic pump (not shown), and raise and lower electrohydraulic pilot valves 40,42. The pilot supply valve 38 is included to control the flow of pressurized fluid to the electrohydraulic pilot valves 40,42 and is controllably opened and closed in response to signals from the controller 30. The pilot supply valve 38 is preferably a normally closed on/off pilot valve. The controller 30 generally maintains the pilot supply valve 38 in an "on" state in which pressurized fluid is directed to the electrohydraulic pilot valves 40,42. In response to preselected fault conditions, the controller 30 closes the pilot supply valve 38 and prevents the pressurized fluid from reaching the electrohydraulic pilot valves 40,42.

The electrohydraulic pilot valves 40,42 are preferably normally closed, three-way, proportional pilot pressure control valves and are connected to the raise and lower pilot lines 32,34 via respective raise and lower hydraulic resolvers 44,46. The electrohydraulic pilot valves 40,42 controllably open and close in response to the magnitude of current flowing from the controller 30 to each of the electrohydraulic pilot valves 40,42. The electrohydraulic pilot valves 40,42 are continuously variable between fully opened and fully closed positions at which the resulting electrohydraulic pilot signal directed toward the resolvers 44,46 varies respectively from a maximum pilot pressure to substantially zero pressure.

The raise and lower resolvers 44,46 direct one of the electrohydraulic pilot signal and the lever pilot signal to a main valve 48 having raise and lower ports 50,52 that are connected respectively to the raise and lower pilot lines 32,34. The raise resolver 44 receives the electrohydraulic pilot signal from the raise electrohydraulic pilot valve 40 and the lever pilot signal from the raise pilot line 32. The raise resolver 44 allows the pilot signal having the greater pressure to flow to the raise port 50 of the main valve 48 and prevents the pilot signal having the lesser pressure from reaching the main valve 48. Thus, if the lever pilot signal has a pressure that is greater than that of the electrohydraulic pilot signal, the main valve 48 is controlled in response to the position of the control lever 24; whereas if the electrohydraulic pilot signal has a pressure that is greater than that of the lever pilot signal, the main valve 48 is controlled in response to the magnitude of current flowing from the controller 30 to the electrohydraulic valve 40. While the operation of only the raise resolver 44 has been described, it should be appreciated that the lower resolver 46 operates in a similar fashion.

The main valve 48 is connected to and between the raise and lower pilot lines 32,34, a hydraulic pump (not shown), and the lift cylinders 18. The raise and lower pilot lines 32,34 are respectively connected to the main valve 48 at the raise and lower ports 50,52. The main valve 48 serves to controllably direct pressurized fluid to the head end and rod end of the lift cylinders 18 in response to receiving pilot signals in the raise and lower ports 50,52. Since the raise and lower resolvers 44,46 each direct one of either the lever or electrohydraulic pilot signals to the raise and lower ports 50,52, the lift cylinders 18 are controllably extended and retracted in response to the pilot signals being directed to the main valve 48 by the resolvers 44,46.

The main valve 48 is also connected to a fluid reservoir (not shown). In the preferred embodiment, the main valve 48 performs a float operation by connecting the hydraulic circuits associated with both the rod end and head end of the hydraulic cylinder 18 to the fluid reservoir in response to receiving a float pressure signal from the electrohydraulic pilot valves 40,42. When the float operation is performed, the implement is lowered in response to the force of gravity rather than in response to pressurized fluid being applied to the rod end of the hydraulic cylinder 18.

A kickout set switch 54 is included in connection with the controller 30 to allow the operator to select the desired kickout heights described above. The kickout set switch 54 typically includes a push button 56 which is preferably mounted to the vehicle 12 at the operator's station. When the operator actuates the push button 56, the controller 30 reads the lift cylinder extension signal from the lift cylinder extension sensor 22 and preferably compares the magnitude of the cylinder extension signal to a predetermined magnitude corresponding to the midpoint illustrated in FIG. 2. If the lift cylinder extension signal is greater than the predetermined magnitude, the lift cylinder extension signal is stored in a non-volatile memory in the controller 30 at an upper kickout address (not shown). If the lift cylinder extension signal is less than the predetermined magnitude, the lift cylinder extension signal is stored in the non-volatile memory at a lower kickout address (not shown), and the controller 30 reads the tilt cylinder extension signal from the tilt cylinder extension sensor 23 and stores the signal in the non-volatile memory at a desired bucket position address. Thus when the operator actuates the push button 56 when the lift arm assembly 14 is below the midpoint, signals are stored in memory which identify the desired location of a front portion of the bucket 16 when the implement is lowered.

In the preferred embodiment, the controller 30 is connected to a tilt detent mechanism (not shown). In the event that the bucket 16 is tilted below the position corresponding to the signal stored at the desired bucket position address and a tilt control lever (not shown) is moved to a rackback detent position, the tilt detent mechanism is actuated to maintain the control lever in that position. The tilt cylinder 20 responsively moves the bucket toward the position defined by the signal stored at the desired bucket position address. As the bucket is tilting, the controller 30 senses the tilt cylinder extension signal and deactuates the tilt detent mechanism in response to the tilt cylinder extension signal being substantially equivalent to the signal stored at the desired bucket position address. When the tilt detent mechanism is deactuated, the tilt control lever returns to a neutral position and the tilt cylinder 20 maintains the bucket in substantially the same position with respect to the lift arm assembly 14.

In the preferred embodiment, the controller 30 also periodically samples the lift cylinder extension signals and calculates the velocity of the lift arm assembly 14 in response to recently sampled cylinder extension signals.

Figure 4:
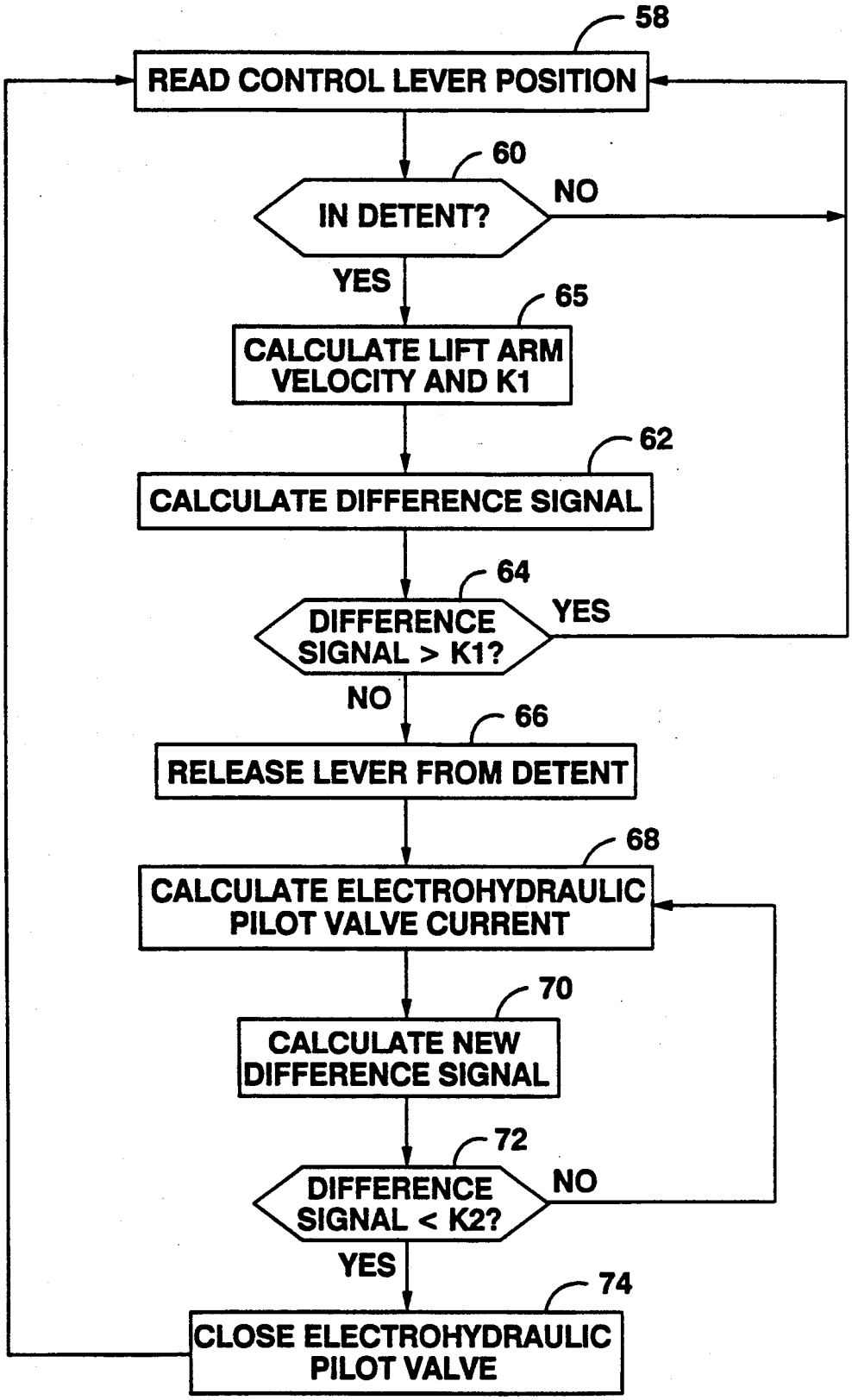
FIG. 4 is a generalized flow chart of the operation of a portion of an embodiment of the invention.

Referring now to FIG. 4, the embodiment of the instant invention which slows the implement before reaching the lift kickout height is described. It is assumed that the operator has previously selected the lift kickout height and lower kickout height by respectively moving the lift arm assembly to the desired dump and return to dig positions and activating the kickout set switch. Thus, cylinder extension signals are stored in the controller 30 at the respective upper and lower kickout addresses. It should be appreciated that default kickout heights may be stored in the controller memory to use as the raise and lower kickout heights if the operator does not select the raise and lower kickout heights himself.

The operator moves the control lever 24 to extend the lift cylinders 18 and raise the bucket. At this point, the electrohydraulic valves are closed and the lever operated pilot valve 28 is producing the lever operated pilot signal. Since the lever operated pilot signal now has a greater pressure than the electrohydraulic pilot signal, the resolver directs the lever operated pilot signal to the main valve 48.

The controller 30 reads 58 the lever position signal from the control lever position sensor 36 and determines 60 whether the control lever 24 is positioned outside the range defined by the upper and lower detent positions. This function is performed by comparing the lever position signal to predetermined signals corresponding to the lever position signal when the control lever 24 is in the raise and lower detent positions. If the lever position signal is within the range between the two predetermined magnitudes, the controller continues to read 58 the lever position signal and the detent mechanism 26 is not engaged. However, if the lever position signal is outside the range defined by the predetermined magnitudes, the detent mechanism 26 engages the control lever 24.

Following the actuation of the detent mechanism 26, the controller 30 calculates a difference signal. In the preferred embodiment, the calculation of the difference signal entails determining whether the control lever is positioned to cause the lift arm assembly to raise or to lower, reading the present lift cylinder extension signal, selecting the appropriate raise or lower kickout address in response to the position of the control lever, and subtracting the present lift cylinder extension signal from the lift cylinder extension signal in the selected kickout address.

The difference signal is then compared 64 to a predetermined constant, K1. The predetermined constant, K1, is preferably chosen to reflect the difference between the kickout begin-modulation-position, illustrated in FIG. 2, and the associated kickout height. Thus, the value of K1 determines the distance through which the lift arm assembly 14 moves as it is brought to a stop. A relatively large difference signal infers a gradual stopping of the lift arm assembly 14; whereas a relatively small difference signal infers bringing the lift arm assembly 14 to a stop in a relatively short distance.

While K1 may be a set value irrespective of lift arm velocity, the preferred embodiment calculates 65 K1 as a function of the velocity of the lift arm assembly and provides a substantially larger stopping distance when the lift arm assembly is moving relatively quickly. It should be appreciated that K1 may also be determined in response to other sensed parameters, such as the acceleration of the implement.

If the difference signal is greater than K1, the lift arm assembly 14 is not between the kickout begin-modulation-position and the associated kickout height and normal operator-lever control continues. If the difference signal is less than K1, the lift arm assembly 14 is between the kickout begin modulation position and the associated kickout height and the controller 30 produces a kickout signal 66 to cause the detent mechanism 26 to release the control lever 24 from the detent position.

When the control lever 24 is released, the control lever 24 returns to the neutral position at which the lever operated pilot valve 28 is closed. As the control lever 24 begins to move toward the neutral position, a modulation process is begun in which the controller 30 calculates 68 the magnitude of current to be directed to the raise electrohydraulic pilot valve 40. The magnitude of current is chosen as a function of the difference signal and position of the control lever 24 prior to being released from the detent position. The raise electrohydraulic pilot valve 40 is preferably opened sufficiently to produce a pilot signal having a pressure substantially equivalent to or slightly less than the pressure of the lever pilot signal prior to the control lever 24 being released from the detent position. Advantageously, the electrohydraulic pilot signal is produced before the pressure of the lever pilot signal is significantly reduced. Once the electrohydraulic pilot signal is produced and the pressure of the lever pilot signal begins to decrease, the pressure of the electrohydraulic pilot signal is greater than the pressure of the lever pilot signal. As a result, the resolver 44 directs the electrohydraulic pilot signal to the main valve 48 in place of the lever pilot signal.

The controller 30 then calculates 70 the difference signal and compares 72 the difference signal to a second predetermined constant, K2. In the preferred embodiment, the second predetermined constant, K2, is chosen to reflect the distance from the current implement position to the kickout height at which the controller 30 can acceptably bring the lift arm assembly 14 to a complete stop. Thus, K2 defines an acceptable error range in which the lift arm assembly 14 may be stopped.

If the difference signal is less than K2, then the electrohydraulic pilot valves are completely closed. However, if the difference signal is greater than K2, then the controller 30 calculates 68 the electrohydraulic pilot valve current as a function of the difference signal and the magnitude of the current that was sent to the electrohydraulic pilot valve at the beginning of the modulation process. In the preferred embodiment, the electrohydraulic pilot valve current is directly proportional to the ratio of the present difference signal to the difference signal calculated at the beginning of the modulation process. Thus, the electrohydraulic pilot valve current is directly proportional to the distance from the implement to the lift kickout height when the implement is within the respective modulation region defined by the kickout height and the begin-modulation-position. As a result, the electrohydraulic pilot valve 40 is progressively closed and the implement velocity is gradually reduced as the implement approaches the kickout height.

When the function described in FIG. 4 is used to lower the implement to the lower kickout height, the controller 30 reads the tilt cylinder extension sensor 23 to determine whether the bucket is tilted such that the front portion of the bucket 16 will impact the ground before the lift arm assembly 14 is lowered to the lower kickout height. To prevent this contingency, the controller 30 compares the signal from the tilt cylinder extension sensor 23 to a predetermined signal stored in memory and compensates the signal stored at the lower kickout address when the bucket is tilted below the position defined by the predetermined signal. The compensated lower kickout signal is calculated such that when the lift arm assembly 14 is in the position defined by the compensated lower kickout signal, the front portion of the bucket is substantially located at the position defined by the uncompensated lower kickout signal and the desired bucket position. In the event that buckets of various sizes and shapes are used in connection with a vehicle including the instant invention, the bucket extending the largest distance from the lift arm assembly is advantageously used to select the bucket position defined by the predetermined signal.

The cushioning function described in connection with FIG. 4 is also operable to gradually slow the lift arm assembly as it approaches the maximum lift height when the lift arm assembly is substantially at or above the lift kickout height and the control lever 24 is at the raise detent position. However, the maximum lift height is used in place of the lift kickout height and the predetermined constant, K1, is chosen in response to the maximum lift height and the position at which modulation is to begin. In addition, K2 is substantially at or less than zero since it is advantageous for the lift arm assembly to lightly impact the mechanical stop thus providing feedback to the operator that the lift arm assembly is at the maximum lift height. Essentially, the maximum lift height serves as a second lift kickout height when the lift arm assembly is substantially at or above the first lift kickout height and the control lever 24 is at the raise detent position.

At any time that the control lever 24 is engaged with the detent mechanism 26, the operator may regain control of the control lever 24 by exerting a force on the control lever 24 toward the neutral position. When the force exerted by the operator exceeds that of the detent mechanism 26, the control lever 24 begins to move toward the neutral position. The controller 30 senses the resulting control lever motion via the control lever position sensor 36 and produces a kickout signal to cause the detent mechanism 26 to release the control lever 24 from the detent position As the detent mechanism 26 is released, the controller 30 substantially closes the electrohydraulic pilot valves 40,42 to return control of the implement to the operator.

Figure 5:
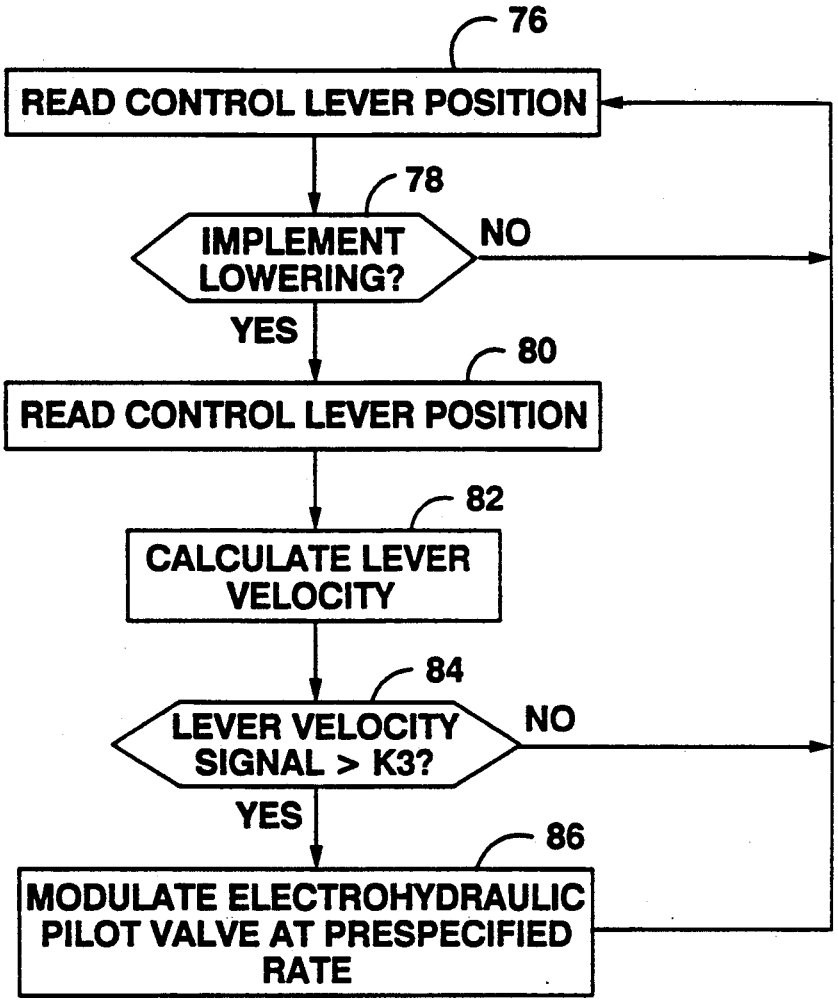
FIG. 5 is a generalized flow chart of the operation of a portion of an embodiment of the invention.

The function of preventing the operator from abruptly changing the velocity of the implement when it is being lowered is best described with reference to FIG. 5. The controller 30 reads 76 the lever position signal to determine 78 whether the bucket 16 is being lowered.

If the control lever 24 is not displaced to a position at which the lever pilot signal causes the main valve 48 to retract the lift cylinders 18 and hence lower the implement, the controller 30 continues to monitor the control lever position by passing control back to block 76. However, if the control lever 24 is in a lowering position, the controller 30 reads 80 the lever position signal and calculates 82 a lever velocity signal in response to recently sampled lever position signals.

The lever velocity signal is compared to a third predetermined constant, K3. In the preferred embodiment, the third predetermined constant, K3, is chosen to reflect the maximum rate at which the lower pilot valves are to be closed, which is referred to as the snap limit. When the control lever 24 is moved from a lowering position toward the neutral position at a rate greater than the snap limit, undue stresses are absorbed by the lift arm assembly 14 and operator comfort is reduced; thus it is advantageous to operate the main valve 48 in response to an electrohydraulic pilot signal that is changing at an acceptable rate rather than in response to the lever pilot signal which is changing too quickly.

If the lever velocity signal is less than or equal to the third predetermined constant, K3, normal operator lever control continues. However, if the lever velocity signal is greater than K3, the controller 30 produces an electrohydraulic pilot valve current to open the electrohydraulic pilot valve to produce a pilot signal having a pressure substantially equal to that of the lever pilot signal prior to the quick motion of the control lever. The controller 30 modulates the electrohydraulic pilot valve current at a prespecified rate which corresponds to the snap limit. Therefore, when the lever pilot signal pressure is decreasing faster than the prespecified rate and the electrohydraulic pilot signal pressure is changing at the prespecified rate, the electrohydraulic pilot signal pressure is greater than the lever pilot signal pressure and the lower resolver 46 resultingly directs the electrohydraulic pilot signal to the main valve 48 in place of the lever pilot signal. In this way, the main valve 48 is not allowed to close quickly enough to cause stresses to be exerted on the lift arm assembly, hydraulic circuit, and operator.

An embodiment of the invention will now be described in connection with the function of slowing the implement before a mechanical stop impacts a portion of the lift arm assembly 14 or lift cylinders 18. It is assumed that the operator has moved the control lever 24 to cause the lever operated pilot valve 28 to direct the lever pilot signal to one of the raise and lower pilot lines 32,34. The controller 30 reads the lift cylinder extension signal and determines whether the implement is nearing one of either the maximum lift arm height or the minimum lower position illustrated in FIG. 2. If the implement is approaching such a position, the controller 30 delivers a current to the electrohydraulic pilot valve which is connected to the other of the raise and lower pilot lines 32,34.

For example, when the operator moves the control lever 24 to raise the implement, the raise resolver 44 is directing the lever pilot signal to the raise port 50 of the main valve 48. As the implement reaches a predetermined distance from the maximum lift height, the controller 30 opens the lower electrohydraulic pilot valve 42 to produce an electrohydraulic pilot signal in response to the position of the lift arm assembly 14 and control lever 24 and the velocity of the lift arm assembly 14. The lower resolver 46 directs the electrohydraulic pilot signal to the lower port 52 of the main valve 48. The controller 30 increases the current flowing to the electrohydraulic pilot valve as the implement approaches the maximum lift height thus increasing the pressure of the electrohydraulic pilot signal flowing to the lower port 52. Since the lever and electrohydraulic pilot signals are directed to opposing ports on the main valve 48, the electrohydraulic pilot signal increasingly counteracts the effect of the lever pilot signal as the implement approaches the maximum lift height thus progressively closing the main valve 48. When the implement reaches the maximum lift height, the pressure of the electrohydraulic pilot signal is substantially equal to that of the lever pilot signal, the main valve 48 is substantially closed, and the motion of the implement is stopped.

Advantageously, the main valve 48 is slightly open when the maximum lift height is reached. This allows a slight impact to occur as the lift arm assembly reaches the mechanical stop and provides the operator with feedback indicating that the maximum lift height has been reached.

An embodiment of the invention will now be described in connection with the float operation. When the signal from the lift cylinder extension sensor 22 indicates that the lift arm assembly is substantially at or below the lower kickout position and the lever position sensor 36 indicates that the control lever 24 is at the lower detent position, the controller 30 delivers a signal to the lower electrohydraulic pilot valve 42 to produce a float pressure signal which causes the main valve 48 to connect the hydraulic circuits associated with both the rod end and head end of the hydraulic cylinder 18 to the fluid reservoir. Thus, the implement is lowered in response to the force of gravity rather than in response to pressurized fluid being applied to the rod end of the hydraulic cylinder 18. In the preferred embodiment, the main valve 42 continues to perform the float operation until the operator manually moves the control lever 24 from the lower detent position toward the neutral position.

While each of the above functions were described separately, it should be appreciated that the preferred embodiment includes all of the described functions.

INDUSTRIAL APPLICABILITY

Vehicles such as wheel type loaders include work implements capable of being moved through a number of positions during a work cycle. The typical work cycle associated with a bucket includes positioning the bucket and associated lift arm assembly in a digging position for filling the bucket with material, a carrying position, a raised position, and a dumping position for removing material from the bucket.

Embodiments of the present invention are useful in connection with such vehicles to progressively slow the velocity of the implement during a work cycle rather than abruptly stopping or changing the velocity of the implement. Such a function is particularly worthwhile to slow the implement before it reaches a kickout position, to prevent the operator from abruptly changing the velocity of the implement when it is being lowered, and to slow the implement before a mechanical stop impacts a portion of the lift arm assembly 14 or lift cylinders 18.

It should be understood that while the function of the preferred embodiment is described in connection with the lift arm assembly and associated hydraulic circuits, the present invention is also applicable to the control of the bucket position as well as other implements used on wheel type loaders, track type loaders, hydraulic excavators, backhoes, and similar vehicles having hydraulically operated implements.

It should be further understood that the present invention has been described in connection with a pilot operated hydraulic system by way of illustration and not limitation. The present invention is equally operable in systems in which the main valve 48 is omitted and the resolvers 44,46 are connected directly to the hydraulic cylinders.

Other aspects, objects, and advantages of this invention can be obtained from a study of the drawings, the disclosure, and the appended claims.

We claim:

1. A method for controllably raising and lowering an implement relative to a work vehicle, said implement being connected to said work vehicle and movable to and between maximum raised and lowered positions in response to the extension and retraction of a hydraulic cylinder, said work vehicle including a control lever being movable to and between a neutral position, a predetermined raise detent position, and a predetermined lower detent position, comprising the steps of:

producing a lever pilot signal in response to the position of said control lever, said lever pilot signal having a first pilot pressure;

producing an electrohydraulic pilot signal having a second pilot pressure in response to movement of the control lever;

selecting the greater of said first and second pilot pressures; and controlling the position of the implement in respose to the selected pressure.

2. A method for controllably raising and lowering an implement relative to a work vehicle, said implement being connected to said work vehicle and movable to and between maximum raised and lowered positions in response to the extension and retraction of a hydraulic cylinder, said work vehicle including a control lever being movable to and between a neutral position, a predetermined raise detent position, and a predetermined lower detent position, comprising the steps of:

producing a lever pilot signal in response to the position of said control lever, said lever pilot signal having a first pilot pressure;

producing an electrohydraulic pilot signal having a second pilot pressure, said electrohydraulic pilot signal being produced in response to said control lever being moved beyond one of the raise and lower detent positions;

selecting the greater of said first and second pilot pressures;

controlling the position of the implement in response to the selected pressure;

sensing the position of the implement with respect to the work vehicle and responsively producing a position signal;

selecting a kickout position and responsively producing a kickout position signal;

moving said control lever to said neutral position in response to the implement being a preselected distance from the kickout position; and producing a difference signal in response to said position signal and kickout position signal; said second pressure being a function of said difference signal.

3. A method, as set forth in claim 2, including the steps of moving said control lever to said neutral position in response to the implement being a preselected distance from the maximum raised position and producing a second difference signal in response to said position signal and the maximum raised position; said second pilot pressure being a function of said second difference signal.

4. A method, as set forth in claim 2, including the steps of:

producing a tilt signal; and compensating said kickout position signal in response to said tilt signal.

5. A method for controllably raising and lowering an implement relative to a work vehicle, said implement being connected to said work vehicle and movable to and between maximum raised and lowered positions in response to the extension and retraction of a hydraulic cylinder, said work vehicle including a control lever being movable to and between a neutral position, a predetermined raise detent position, and a predetermined lower detent position, comprising the steps of:

producing a lever pilot signal in response to the position of said control lever, said lever pilot signal having a first pilot pressure;

producing an electrohydraulic pilot signal having a second pilot pressure;

selecting the greater of said first and second pilot pressures;

controlling the position of the implement in respose to the selected pressure, and connecting the hydraulic circuits associated with the rod end and head end of the hydraulic cylinder to a fluid reservoir in response to said control lever being in the lower detent position and said implement being substantially at or below a lower kickout position.

6. A method for controllably raising and lowering an implement relative to a work vehicle, said implement being connected to said work vehicle and movable to and between maximum raised and lowered positions in response to the extension and retraction of a hydraulic cylinder, said work vehicle including a control lever being movable to and between a neutral position, a predetermined raise detent position, and a predetermined lower detent position, comprising the steps of:

producing a lever pilot signal in response to the position of said control lever, said lever pilot signal having a first pilot pressure;

sensing the velocity of the control lever and responsively producing a velocity signal;

producing an electrohydraulic pilot signal having a second pilot pressure, said electrohydraulic pilot signal being produced in response to said velocity signal being greater than a predetermined velocity signal magnitude;

selecting the greater of said first and second pilot pressures; and controlling the position of the implement in response to the selected pressure.

7. A method, as set forth in claim 6, including the step of changing said second pressure at a prespecified rate in response to said velocity signal being greater than said predetermined velocity signal magnitude.

8. A method for controllably raising and lowering an implement relative to a work vehicle, said implement being connected to said work vehicle and movable to and between maximum raised and lowered positions in response to the extension and retraction of a hydraulic cylinder, said work vehicle including a main valve having a raise port and a lower port a control lever being movable to and between a neutral position, a predetermined raise detent position, and a predetermined lower detent position, comprising the steps of:

producing a lever pilot signal in response to the position of said control lever, said lever pilot signal having a first pilot pressure;

directing said lever pilot signal to one of said raise and lower ports;

producing an electrohydraulic pilot signal having a second pilot pressure;

directing said electrohydraulic pilot signal to the other of said raise and lower ports in response to the implement being within a predetermined distance from and being moved toward one of the maximum raised and lowered positions;

selecting the greater of said first and second pilot pressures; and controlling the position of the implement in respose to the selected pressure.

9. An apparatus for controllably raising and lowering an implement relative to a work vehicle, said implement being pivotally connected to said work vehicle and movable to and between maximum raised and lowered positions in response to the extension and retraction of a hydraulic cylinder, comprising:

a control lever movably connected to the work vehicle;

means for producing a lever pilot signal in response to the position of said control lever, said lever pilot signal having a first pilot pressure;

means for producing an electrohydraulic pilot signal in response to movement of said control lever, said electrohydraulic pilot signal having a second pilot pressure;

means for selecting the greater of said first and second pilot pressures; and means for controlling the position of the implement in response to the selected pressure.

10. An apparatus for controllably raising and lowering an implement relative to a work vehicle, said implement being pivotally connected to said work vehicle and movable to and between maximum raised and lowered positions in response to the extension and retraction of a hydraulic cylinder, comprising:

a control lever movably connected to the work vehicle, said control lever having a neutral position and being movable to and between a predetermined raise detent position and a predetermined lower detent position;

means for producing a lever pilot signal in response to the position of said control lever, said lever pilot signal having a first pilot pressure;

means for producing an electrohydraulic pilot signal in response to said control lever being moved beyond one of said predetermined raise and lower detent positions, said electrohydraulic pilot signal having a second pilot pressure;

means for selecting the greater of said first and second pilot pressures and responsively controlling the position of the implement in response to the selected pressure;

means for sensing the position of the implement with respect to the work vehicle and responsively producing a position signal;

means for selecting a kickout position and responsively producing a kickout position signal;

means for moving said control lever to said neutral position in response to the implement being a preselected distance from the kickout position; and means for producing a difference signal in response to said position signal and kickout position signal; said second pilot pressure being a function of said difference signal.

11. An apparatus, as set forth in claim 10, including means for moving said control lever to said neutral position in response to the implement being a preselected distance from the maximum raised position; and wherein said means for producing a difference signal produces a second difference signal in response to said position signal and the maximum raised position; said second pilot pressure being a function of said second difference signal.

12. An apparatus, as set forth in claim 10, including a main valve means for controllably directing pressurized fluid to a rod end and a head end of a hydraulic cylinder and for connecting the hydraulic circuits associated with the rod end and head end of the hydraulic cylinder to a fluid reservoir in response to said control lever being in the lower detent position and said implement being substantially at or below a lower kickout position.

13. An apparatus, as set forth in claim 10, wherein said kickout position signal is stored in a controller at an upper kickout address in response to having a magnitude that is greater than a predetermined amount, and at a lower kickout address in response to having a magnitude that is less than the predetermined amount.

14. An apparatus, as set forth in claim 10, wherein said preselected distance is a function of the velocity of the implement and said second pressure is directly proportional to said difference signal when the implement is less than said preselected distance from the kickout position.

15. An apparatus, as set forth in claim 10, including means for sensing the velocity of the control lever and responsively producing a velocity signal; and wherein said electrohydraulic pilot signal is produced in response to said velocity signal being greater than a predetermined velocity signal magnitude.

16. An apparatus, as set forth in claim 15, including means for changing the second pressure at a prespecified rate in response to said velocity signal being greater than said predetermined velocity signal magnitude.

17. An apparatus, as set forth in claim 10, including a main valve having a raise port and a lower port and wherein:

said lever pilot signal is directed to one of said raise and lower ports; and said electrohydraulic pilot signal is directed to the other of said raise and lower ports in response to the implement being within a predetermined distance from and being moved toward one of the maximum raised and lowered positions.

18. An apparatus, as set forth in claim 10, wherein said second pressure is substantially reduced in response to the control lever moving from one of the predetermined raise and lower detent positions toward the neutral position when the implement is substantially farther than said preselected distance from the kickout position.

19. An apparatus, as set forth in claim 10, including a means for producing a tilt signal and wherein said kickout position signal is compensated in response to said tilt signal.

20. An apparatus, as set forth in claim 10, wherein said second pressure is directly proportional to said difference signal when the implement is less than said preselected distance from the kickout position.

21. An apparatus, as set forth in claim 10, wherein said means for producing a difference signal produces a second difference signal in response to said position signal and the maximum raised position.

22. An apparatus for controllably raising and lowering an implement relative to a work vehicle, said implement being pivotally connected to said work vehicle and movable to and between maximum raised and lowered positions in response to the extension and retraction of a hydraulic cylinder, comprising:

a control lever movably connected to the work vehicle;

means for producing a lever pilot signal in response to the position of said control lever, said lever pilot signal having a first pilot pressure;

means for sensing the velocity of the control lever and responsively producing a velocity signal;

means for producing an electrohydraulic pilot signal having a second pilot pressure in response to said velocity signal being greater than a predetermined velocity signal magnitude;

means for selecting the greater of said first and second pilot pressures; and means for controlling the position of the implement in response to the selected pressure.

23. An apparatus, as set forth in claim 22, including means for changing said second pressure at a prespecified rate in response to said velocity signal being greater than said predetermined velocity signal magnitude.

24. An apparatus for controllably raising and lowering an implement relative to a work vehicle, said implement being pivotally connected to said work vehicle and movable to and between maximum raised and lowered positions in response to the extension and retraction of a hydraulic cylinder, comprising:

a control lever movably connected to the work vehicle;

a main valve having a raise port and a lower port;

means for producing a lever pilot signal in response to the position of said control lever, said lever pilot signal having a first pilot pressure, said lever pilot signal being directed to one of said raise and lower ports;

means for producing an electrohydraulic pilot signal having a second pilot pressure, said electrohydraulic pilot signal being directed to the other of said raise and lower ports in response to the implement being within a predetermined distance from and being moved toward one of the maximum raised and lowered positions;

means for selecting the greater of said first and second pilot pressures; and means for controlling the position of the implement in response to the selected pressure.

25. An apparatus for controllably raising and lowering an implement relative to a work vehicle, said implement being pivotally connected to said work vehicle and movable to and between maximum raised and lowered positions in response to the extension and retraction of a hydraulic cylinder, comprising:

a control lever movably connected to the work vehicle;

means for producing a lever pilot signal in response to the position of said control lever, said lever pilot signal having a first pilot pressure;

means for producing an electrohydraulic pilot signal having a second pilot pressure;

means for selecting the greater of said first and second pilot pressures;

means for controlling the position of the implement in response to the selected pressure; and a main valve means for controllably directing pressurized fluid to a rod end and a head end of a hydraulic cylinder and for connecting the hydraulic circuits associated with the rod end and head end of the hydraulic cylinder to a fluid reservoir in response to said control lever being in a lower detent position and said implement being substantially at or below a lower kickout position.

* * * * *